United States Patent [19]

Chen

[11] Patent Number: 4,821,838

[45] Date of Patent: Apr. 18, 1989

[54] ACOUSTIC DAMPER

[75] Inventor: James N. C. Chen, Chelmsford, Mass.

[73] Assignee: Hewlett-Packard Company, Palo Alto, Calif.

[21] Appl. No.: 115,216

[22] Filed: Oct. 30, 1987

[51] Int. Cl.[4] ..... H04R 7/00

[52] U.S. Cl. ..... 181/175; 181/148; 181/198; 367/152; 367/171; 367/176; 367/188; 381/91; 381/158

[58] Field of Search ..... 181/158, 175, 176, 198, 181/148; 367/152, 171, 176, 188; 381/91, 158

[56] References Cited

U.S. PATENT DOCUMENTS

| | | | |
|---|---|---|---|
| 2,434,666 | 1/1948 | Mason | 367/171 |
| 2,497,680 | 2/1950 | Massa | 367/152 |
| 3,108,247 | 10/1963 | Harris | 367/171 |
| 4,450,544 | 5/1984 | Dencro et al. | 181/151 X |

*Primary Examiner*—B. R. Fuller
*Attorney, Agent, or Firm*—Frank R. Perillo

[57] ABSTRACT

An acoustic damper for substantially reducing the reverberation echoes at the junction between an acoustic signal propagating fluid and a material having an acoustic impedance substantially different from that of the fluid. The damper, which is particularly adapted for use in ultrasonic transducers, is formed of a material having an acoustic impedance which substantially matches the acoustic impedance of the fluid, such material preferably being a foam plastic material having sufficient hardness to be acoustically stable. For preferred embodiments, the damper is formed of a laminate of the layer described above and a second layer of a material which provides high acoustic attenuation, such as cork material.

22 Claims, 1 Drawing Sheet

ACOUSTIC DAMPER

FIELD OF THE INVENTION

This invention relates to acoustic dampers and more particularly to an acoustic damper for substantially reducing reverberation echoes at the junction between an acoustic signal propagating fluid and a material having an acoustic impedance substantially different from that of the fluid. The acoustic damper of this invention is particularly adapted for use in ultrasonic transducers such as those utilized in ultrasonic medical imaging systems.

BACKGROUND OF THE INVENTION

In ultrasonic imaging systems, an acoustic signal is transmitted by a transducer element to the object being imaged and the echo of the acoustic signal bouncing off such object is detected by the transducer and used in a well known manner to produce an image of the object. In order to propagate the acoustic signal and to minimize echoes at the point where the acoustic signal enters the object being imaged, the transducer is typically immersed in a fluid having an acoustic impedance which substantially matches that of the object. Thus, where such transducers are being utilized to do ultrasonic medical imaging, the fluid utilized in such transducers has an acoustic impedance which substantially matches that of human body tissue. While the portion of the housing in which the fluid is encased, and through which the ultrasonic signal is projected, can be formed of a material, such as various plastics, which has an acoustic impedance which does not substantially differ from that of the fluid, the fact that the acoustic impedance of the plastic or other material through which the signal is projected does not exactly match that of the fluid results in a certain portion of the acoustic signal being reflected back into the fluid at the fluid/plastic junction. The percentage of the signal being reflected back at the fluid/plastic junction is typically quite small, for example approximately 5% of the acoustic signal. While some of this signal is immediately reflected back to the transducer, and can be ignored by the imaging circuitry, depending on the angle at which the acoustic signal is being transmitted, varying portions of the reflected signal bounce off other elements either in or forming the walls of the chamber encasing the transducer fluid. Some of these elements are formed of material such as aluminum or other metal having an acoustic impedance substantially different from that of the fluid, resulting in significant reverberation echoes being formed at the junction between the fluid and such material. Since the sensing elements utilized in such transducers are extremely sensitive, they pick up such reverberation echoes. This results in unwanted echoes or other spurious elements, which spurious elements can interfere with the intended use of the image.

Heretofore, an effective technology has not existed for economically dealing with such reverberation echoes, particularly for relatively small transducers, such as those used for medical imaging, where there is little space for damping elements. Most transducers have merely accepted the spurious elements caused by such reverberation echoes and no effort has been made to damp them. To the extent any effort has been made to deal with the problem, such efforts involved placing material having a high acoustic-attenuation characteristic at the junction between the fluid and the metal or other material causing the reverberation echo. However, since the acoustic impedance of such materials also differs substantially from that of the fluid, reverberation echoes also form at the junction of such material with the fluid, resulting in limited improvement in the image provided by the transducer.

Another problem with using esisting attenuators is that, to the extent such materials are porous and/or have irregular surfaces, they may trap air which may get into the fluid filled chamber. Since air is a perfect reflector, any trapped air, particularly air trapped at the surface of the attenuator, can result in the attenuator enhancing rather than reducing the reverberation echo effect.

It is therefore a primary object of this invention to eliminate, or at least substantially reduce, spurious images caused by reverberation echoes in acoustic transducers.

A more general object of this invention is to provide an acoustic damper capable of substantially eliminating reverberation echoes at the junction between a fluid and a material having an acoustic impedance substantially different from that of the fluid.

Another object of this invention is to provide an acoustic damper of the type indicated above which is suitable for use in small transducers such as those used for medical imaging.

Still another object of this invention is to provide an acoustic damper of the type indicated above which does not trap or absorb air and therefore remains acoustically stable.

SUMMARY OF THE INVENTION

In accordance with the above, this invention provides an acoustic damper which substantially eliminates reverberation echoes at the junction between an acoustic signal propagating fluid and a material having an acoustic impedance substantially different from that of the fluid. For preferred embodiments, the fluid is being used to transmit acoustic signals in an ultrasonic transducer of a type having a transducer element which transmits and receives ultrasonic signals through the transducer fluid, the transducer element and fluid being sealed in a chamber at least a portion of the elements in or the walls of which are formed of a material having an acoustic impedance which is substantially different from that of the fluid.

For one embodiment of the invention, the damper includes at least one piece of foam plastic material of a predetermined thickness, the plastic material having a sufficiently high firmness to assure that the material will be acoustically stable. Means are provided for securing the foam plastic material to at least selected portions of the chamber material having the different acoustic impedance, the foam material being positioned between the fluid and such select portions of the chamber material to damp reverberation echoes. The firmness of the foam plastic material should be at least six.

For a preferred embodiment of the invention, the foam material is secured by suitable means to a layer of cork material to form a laminate and the laminate is secured at the junction between the fluid and the housing material with the cork side of the laminate in contact with the housing material. The thickness of the foam material is preferably substantially greater than the thickness of the cork material.

More generally, the laminate is formed of a first layer of material having an acoustic impedance which substantially matches the acoustic impedance of the fluid and of a second layer of material which provides high acoustic attenuation.

The foregoing and other objects, features and advantages of the invention will be apparent in the following more particular description of preferred embodiments of the invention as illustrated in the accompanying drawings.

In the Drawings

DETAILED DESCRIPTION

Figure 1:
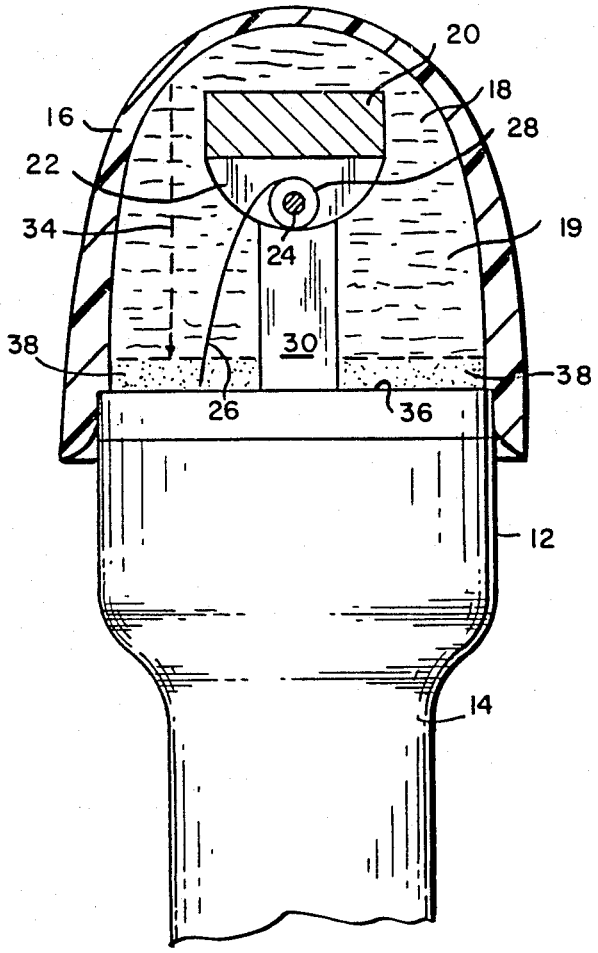
FIG. 1 is a semi-schematic, partially cut-away side view of an ultrasonic transducer incorporating the ultrasonic damper of a first embodiment of the invention.

FIG. 1 shows an ultrasonic transducer 10 of the type in which the acoustic damper of this invention is preferably utilized. Since ultrasonic transducers are well known in the art, and the specific mechanical and electrical configurations of the transducer 10 do not form part of the present invention, FIG. 1 shows only so much of the transducer 10 as is required to understand the invention, and the transducer 10 will only be described in sufficient detail for such understanding.

The transducer 10 may, for example, consist of a main housing 12 formed of aluminum, or other suitable material in which is housed a drive motor (not shown) for the transducer and various other mechanical and electrical components required for the operation of the transducer. Since the transducer is typically a hand-held device, the portion 14 of the transducer may be in the shape of a handle.

A cap 16 of plastic or other suitable material is screwed or otherwise secured on top of housing 12 to form a sealed chamber 18 which is filled with the transducer fluid 19. The exact fluid utilized in chamber 18 will vary with application. For medical scanning applications, the fluid might, for example, be an oil.

An ultrasonic transmitting and receiving element 20 is mounted to a base 22. The base 22 is adapted to rock about a pin or shaft 24 under control of a flexible member 26 which is attached at one end to a motor (not shown) in housing 12 and at the other end wraps around pulley 28 and is attached thereto. A support 30 may be provided in the chamber for base 22 and pins 24. Member 26 may, for example, move base 22 and the transducer element fixed thereto through a predetermined angle in one direction and may control the return of the transducer element in the other direction through the same angle, the return being effected by one or more springs (not shown) mounted to shaft 24 or by other suitable means. Transducer element 20 might also be rocked by a belt connected between the motor and shaft 24 or by other suitable means known in the art.

As previously indicated, most of the acoustic signal generated by element 20 is transmitted through cap 16 to the object to be imaged. However, since the acoustic impedance of the plastic or other material of cap 16 does not exactly match that of the transducer fluid 19 in chamber 18, a small percentage of the acoustic signal, perhaps five percent of the signal, is reflected back into the transducer fluid. While some of the reflected signal immediately strikes transducer 20 and may be ignored by the imaging circuitry, a portion of the reflected signal, as represented by dotted line 34, is reflected to the lower wall or surface 36 of chamber 18. This surface is normally formed of a metal such as aluminum which has an acoustic impedance substantially different from that of the transducer fluid. Since the reverberation echo formed at a junction of two materials is a function both of the difference in acoustic impedance of the materials and of the strength of the incoming acoustic signal, the large acoustic impedance difference at the surface 30 results in a large reverberation echo being reflected from this surface back into the fluid, which echo may appear in the image.

It is noted that reverberation echoes may also be caused by reflected acoustic signals striking surfaces of mounting element 30, or other metallic parts in chamber 18. However, since these parts are smaller than the surface 36, and since the angle of the signal in these parts is less, such reverberation echoes are a less severe problem. While the acoustic damper shown in the drawing is not being utilized to damp reverberation echoes from these parts, if space permits, the teachings of this invention could also be utilized to provide dampers for such echoes.

In accordance with this invention, the reverberation echo formed at surface 36 is substantially damped by securing a layer 38 of a foam plastic material between surface 36 and the fluid in chamber 18. A foam plastic material absorbs a substantial amount of fluid when placed therein, and thus, when secured as shown in FIG. 1, has an acoustic impedance which substantially matches that of the fluid. While foam plastic material in general does not have a high acoustic attenuation, a piece of foam plastic material which is 3 to 5 millimeters thick will result in some attenuation of the acoustic signal passing therethrough. Therefore, while there is substantially no reverberation echo at the junction of the fluid and the foam plastic material because of the substantial acoustic impedance match at this junction, there is a reverberation echo at the junction between the foam plastic material and surface 30. However, the thickness of layer 38 is sufficient to cause a substantial attenuation of the reflected signal 34 before it reaches surface 36 resulting in a significantly reduced reverberation echo, and the reverberation echo signal is further attenuated in passing back through layer 38. The drop through the foam in each direction may, for example, be 10 to 15 db, depending upon the thickness of the foam layer, and this results in an overall attenuation of the reverberation echo signal in the range of 20 to 30 db. This is sufficient to prevent the reverberation echo from adversely affecting the image formed from the transducer's output in most applications. It should be noted that the attenuation characteristics of a material vary with the frequency of the applied acoustic signal. The attenuation values given above, and at other places in the specification, are for an assumed signal frequency of approximately 5 MHz.

Ultrasonic transducers of the type in which this invention is adapted to be utilized are intended for use over long periods of time, generally several years. It is therefore important that the acoustic damping characteristics of the layer 38 remain substantially constant over this period of time. Stated another way, the acoustic damper should be acoustically stable.

However, while chamber 18 is sealed, with changes in environmental conditions, particularly temperature, it is possible for some air to become trapped in the chamber. While it is relatively easy to bleed such air out of the transducer fluid, if air is absorbed into layer 38, it is difficult to remove and virtually impossible to remove in the field. Air absorbed into the foam plastic layer causes a change in the acoustic impedance of this layer, resulting in a mismatch at the junction between layer 38 and the fluid. This mismatch results in a reverberation echo at this junction and substantially defeats the acoustic damping properties of the damper. As previously indicated, air trapped at the surface of layer 38 acts as a near-perfect reflector and can cause a reverberation echo greater than that of surface 36. It is therefore important that the foam plastic material not absorb air which may become trapped in chamber 18 if layer 38 is to remain acoustically stable.

When foam plastic is manufactured, it is compressed from its original size to a smaller size. The ratio of the original size to the final size is defined as the "firmness" of the foam plastic. It has been found that if the firmness of the foam plastic material utilized for layer 38 is less than 6, the layer is not acoustically stable, and is therefore not suitable for use in the acoustic damper of this invention. Since in addition to improving the acoustic stability of the foam plastic material, increased firmness also results in a slight improvement in the attenuation characteristics of the foam plastic, it is desirable that the foam plastic utilized for the layer 38 be as firm as possible. For a preferred embodiment of the invention, 10-900C, Scotfoam, manufactured by Scotfoam, Inc., Eddystone, Pa., is utilized. This is a urethane based foam plastic material having a firmness of 10. Foam plastics having a firmness of up to 16 are currently commercially available and good results hae been obtained with special foam plastics having firmnesses up to 25.

The foam plastic layer 38 may be bonded to surface 36 by suitable plastic rivets, glue or other suitable means. If glue is used, the glue should provide good bonding characteristics and should be compatible with the acoustic fluid 19 used in chamber 18 so that the fluid does not cause a deterioration of the bond over time, and so that the glue does not cause a contamination of the fluid. Further, the glue utilized should not cause a greater acoustic impedance mismatch at the junction than is already being caused by the surface 36. Various commercially available flura-silicon glues are suitable as the bonding agent between layer 38 and surface 36.

Figure 2:
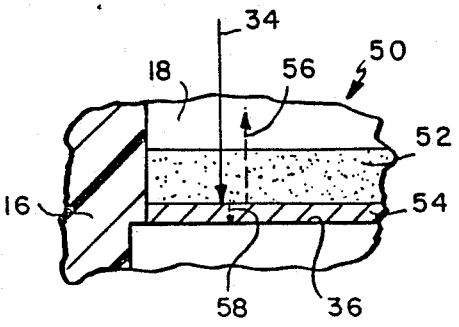
FIG. 2 is a sectional view of a portion of an ultrasonic damper of a second embodiment of the invention.

While layer 38 provides adequate attenuation of the reverberation echoes for most applications, it does not completely eliminate such reverberation echoes. FIG. 2 shows an acoustic damper 50 which may be utilized in place of layer 38 to substantially eliminate reverberation echo signals. In FIG. 2, the same reference numerals have been used as in FIG. 1 for common elements.

The acoustic damping layer 50, which may be substituted for layer 38, is a laminate which consists of a foam plastic layer 52, which is formed of the same material as layer 38, and a cork layer 54. The layers 52 and 54 are bonded together by a suitable glue such as a flura-silicon glue and the cork layer is bonded to surface 36, utilizing the same type of glue. The cork layer, which for example may be formed of cork supplied by Panametrics, Inc., Waltham, Mass., is highly acoustically attenuative. Its acoustic impedance is also much closer to that of the fluid than the acoustic impedance of a metallic surface such as the surface 36 is to the acoustic impedance of the fluid and both its acoustic impedance and its attenuation characteristics are stable with time. For example, assuming the surface 36 is aluminum, the reflection coefficient at the fluid/cork interface is 12 db below that at the fluid/aluminum interface.

Thus, the reflection signal 34 would enter foam plastic layer 52 with substantially no reverberation echo at the fluid/foam interface due to the acoustic impedance match at this surface. The reflected signal is attenuated by 20 to 30 db in the foam plastic layer. Since there is some acoustic impedance mismatch at the foam/cork interface, a reverberation echo is formed at this interface. However, since the impedance match between the foam and cork is better than that between the foam and aluminum, this reverberation echo 56 is weaker than the echo formed at the foam/aluminum junction in the embodiment of FIG. 1. The reverberation echo is also weakened by the fact that the signal has been substantially attenuated in the foam layer. The reverberation echo signal 56 is further attenuated by 20 to 30 db on its return passage through the foam layer 52. There is thus substantially no reverberation echo signal 56 leaving attenuator 50. The cork being highly acoustically attenuative, substantially eliminates the portion of the signal 58 which passes into cork layer 54, so that none of this signal reaches the cork/aluminum interface to cause further reverberation echo. The acoustic impedance match between the metal and cork is therefore not at all critical. Thus, a stable acoustic attenuator 50 is provided which virtually eliminates reverberation echoes.

Since cork layer 54 is highly acoustically attenuative, only a thin layer of cork is required in the laminate. For one embodiment of the invention, a 5 mm thick piece of foam plastic 52 is laminated to a 0.5 mm thick piece of cork. While the exact thicknesses of these two layers, and their relative thicknesses, will vary somewhat with the materials utilized, the application and available space, the thickness of the foam will always be several times thicker than that of the cork layer.

While in FIG. 1, the invention has been shown as utilized in a mechanical ultrasonic transducer, the invention might also be utilized in other ultrasonic transducers to eliminate reverberation echoes, or in other applications where it is desired to substantially reduce or eliminate the reverberation echo formed at the junction between an acoustic propagating fluid and a material having an acoustic impedance substantially different from that of the fluid. Further, while foam plastic and cork have been the two materials utilized in the attenuator of the preferred embodiment of the invention, other materials might be utilized for the layers 38 or 52, or for the layer 54, provided such materials have at least the following characteristics:

A. for the layers 38 or 52:

i. an acoustic impedance which, when immersed in the transducer fluid, substantially matches that of the transducer fluid;

ii. acoustically stable in the intended operating environment;

iii. provides adequate acoustic attenuation, preferably 20 to 35 db for thicknesses of 3 to 5 mm;

B. for the layer 54;

i. has an acoustic impedance which is substantially closer to that of the fluid than is the acoustic impedance of the material of surface 36;

ii. is highly acoustically attenuative;

iii. is stable as to both attenuation and acoustic impedance in its intended environment.

While the invention has been particularly shown and described above with respect to preferred embodiments, the foregoing and other changes in form and detail may be made therein by one skilled in the art without departing from the spirit and scope of the invention.

What is claimed is:

1. An acoustic damper for substantially reducing reverberation echoes at a junction between an acoustic signal propagating fluid and a mismatched material having an acoustic impedance substantially different from that of the fluid, said damper comprising:

at least one piece of foam plastic material of predetermined thickness, said foam plastic material having a sufficiently high firmness to be acoustically stable; and means for securing said foam plastic material to at least selected portions of the mismatched material such that the foam material is positioned between the fluid and such selected portions of the mismatched material.

2. A damper as claimed in claim 1 wherein the foam material has an acoustic impedance when immersed in the fluid is very close to that of the fluid.

3. A damper as claimed in claim 2 wherein the foam material absorbs fluid when immersed therein.

4. A damper as claimed in claim 1 wherein the foam is a urethane based foam.

5. A damper as claimed in claim 1 wherein the firmness of the foam material is at least 6.

6. A damper as claimed in claim 1 wherein the thickness of the foam material is sufficient to achieve a desired level of attenuation for acoustic signals passing therethrough.

7. A damper as claimed in claim 1 including at least one layer of cork material of predetermined thickness; and means for securing said layer of cork material between at least selected pieces of foam material and the mismatched material adjacent thereto.

8. A damper as claimed in claim 7 wherein the thickness of the foam material is at least several times greater than the thickness of the cork material.

9. A damper as claimed in claim 1 wherein said damper is adapted for use in an ultrasonic transducer having a transducer element which transmits and receives ultrasonic signals, said acoustic signal propagating fluid being a transducer fluid through which the ultrasonic signals are propagated, the transducer element and the fluid being sealed in a chamber having therein elements and/or walls at least a portion of which are formed of said mismatched material.

10. An acoustic damper for use in an ultrasonic transducer having a transducer element which transmits and receives ultrasonic signals through a transducer fluid, the transducer element and fluid being sealed in a chamber formed at least in part of a mismatched material having an acoustic impedance which is sufficiently different from an acoustic impedance of the fluid as to cause a reverberation echo to be formed at a junction of said mismatched material with the fluid, said damper comprising:

a layer of foam plastic material of predetermined thickness, said foam material having a sufficiently high hardness to be acoustically stable;

a layer of cork material of a predetermined thickness;

means for securing the layer of foam material to the layer of cork material to form a laminate; and means for securing said laminate to at least selected portions of the mismatched material, the laminate being positioned between the fluid and such selected portions of the housing with the cork layer of the laminate in contact with the housing.

11. A damper as claimed in claim 10 wherein the acoustic impedance of the foam material when immersed in the fluid is sufficiently close to that of the fluid so that there is substantially no reverberation echo at the foam/fluid interface.

12. A damper as claimed in claim 11 wherein the foam material absorbs fluid when immersed therein.

13. A damper as claimed in claim 10 wherein the foam material has a firmness which is at least 6.

14. A damper as claimed in claim 10 wherein the thickness of the foam material is sufficient to achieve a desired level of attenuation for acoustic signals passing therethrough.

15. A damper as claimed in claim 14 wherein the thickness of the foam material is at least several times greater than the thickness of the cork material.

16. A damper as claimed in claim 10 wherein the cork layer has an acoustic impedance which is substantially closer to that of the fluid than is the acoustic impedance of the mismatched material.

17. An acoustic damper for substantially reducing reverberation echoes at a junction between an acoustic signal propagating fluid and a material having an acoustic impedance substantially different from that of the fluid, the damper comprising:

a first layer of material having an acoustic impedance which substantially matches the acoustic impedance of the fluid;

a second layer of material which provides high acoustic attenuation;

means for securing the first and second layers together to form a laminate; and means for securing said laminate to the material having a different acoustic impedance, the laminate being positioned between the fluid and such material with the second layer in contact with the material.

18. A damper as claimed in claim 17 wherein the first and second layers each have a predetermined thickness, the thickness of the first layer (is) being several times the thickness of the second layer.

19. A damper as claimed in claim 17 wherein said first layer is formed of a foam plastic material having a sufficient hardness to be acoustically stable.

20. A damper as claimed in claim 17 wherein said second layer is formed of cork.

21. A damper as claimed in claim 17 wherein said first and second layers are both acoustically stable.

22. A damper as claimed in claim 17 wherein the second layer has an acoustic impedance which is substantially closer to that of the fluid than is the acoustic impedance of the material having a different acoustic impedance.

* * * * *